United States Patent [19]

Green et al.

[11] 4,102,773

[45] Jul. 25, 1978

[54] PYROLYSIS WITH CYCLONE BURNER

[75] Inventors: Norman W. Green, Upland, Calif.; Kandaswamy Duraiswamy, Sterling, Va.; Robert E. Lumpkin, Claremont, Calif.

[73] Assignee: Occidental Petroleum Corporation, Los Angeles, Calif.

[21] Appl. No.: 700,007

[22] Filed: Jun. 25, 1976

[51] Int. Cl.[2] ..... C10B 49/16; C10B 55/08; C10G 1/00

[52] U.S. Cl. ..... 208/8; 48/210; 201/4; 201/8; 201/12; 201/17; 201/22; 201/25; 201/28; 201/30; 201/32; 201/42; 202/99; 208/11 R

[58] Field of Search ..... 201/3, 4, 5, 6, 7, 8, 201/9, 10, 12, 20, 21, 22, 25, 28, 29, 30, 32, 34, 36, 37, 42; 202/99, 108, 121, 122; 259/4 R, 18, 36; 208/8, 11 R; 48/210 US

[56] References Cited

U.S. PATENT DOCUMENTS

| | | | |
|---|---|---|---|
| 1,954,352 | 4/1934 | Dornbrook et al. | 202/108 |
| 2,723,951 | 11/1955 | Minet | 201/9 X |
| 3,655,518 | 4/1972 | Schmalfeld et al. | 202/108 X |
| 3,867,110 | 2/1975 | Scbora et al. | 201/9 X |
| 3,876,392 | 4/1975 | Kalina et al. | 48/210 |
| 3,884,649 | 5/1975 | Matthews | 201/9 X |
| 3,891,402 | 6/1975 | Nahas et al. | 48/197 R |

FOREIGN PATENT DOCUMENTS

| | | |
|---|---|---|
| 520,801 | 1/1956 | Canada. |
| 2,509,352 | 11/1975 | Fed. Rep. of Germany. |
| 75/1,163 | 1/1976 | South Africa. |

*Primary Examiner*—Joseph Scovronek
*Attorney, Agent, or Firm*—Christie, Parker & Hale

[57] ABSTRACT

In a continuous process for recovery of values contained in a solid carbonaceous material, the carbonaceous material is comminuted and then subjected to flash pyrolysis in the presence of a particulate heat source over an overflow weir to form a pyrolysis product stream containing a carbon containing solid residue and volatilized hydrocarbons. After the carbon containing solid residue is separated from the pyrolysis product stream, values are obtained by condensing volatilized hydrocarbons. The particulate source of heat is formed by oxidizing carbon in the solid residue and separating out the fines.

31 Claims, 9 Drawing Figures

PYROLYSIS WITH CYCLONE BURNER

BACKGROUND OF THE INVENTION

Fluid fossil fuels such as oil and natural gas are becoming scarce as these fuels are consumed by a world whose population is continually growing. Also, the supply of oil to industrialized countries has been and could be again interrupted. For these reasons, there is a need for a method for converting solid carbonaceous materials such as oil shale, tar sands, coal and the organic portion of solid waste to liquid and gaseous hydrocarbons.

SUMMARY OF THE INVENTION

This invention is for a continuous process for recovery of values contained in solid carbonaceous materials, and especially in agglomerative coals. In this process a particulate feed stream containing solid carbonaceous material particles of a size less than about 1000 microns in diameter, and preferably less than about 250 microns in diameter in the case of an agglomerative coal, is provided. The feed stream is subjected to flash pyrolysis by transporting the feed stream contained in a carrier gas which is substantially nondeleteriously reactive with respect to products of pyrolysis to a solids feed inlet of a descending flow pyrolysis reactor. The pyrolysis reactor contains a substantially vertically oriented pyrolysis zone operated at a temperature above about 600° F. In addition, a particulate source of heat is fed at a temperature above the pyrolysis temperature to a substantially vertically oriented chamber surrounding the upper portion of the pyrolysis reactor. The inner peripheral wall of the chamber forms an overflow weir to the vertically oriented mixing region of the pyrolysis reactor. The particulate heat source is maintained in a fluidized state in the chamber by an aerating gas which also is substantially nondeleteriously reactive with respect to the products of pyrolysis. The particulate source of heat is discharged over the weir and downwardly into the mixing region at a rate sufficient to maintain the pyrolysis zone at the pyrolysis temperature.

The solid carbonaceous material feed stream and carrier gas are injected from the solids feed inlet into the mixing region to form a resultant turbulent mixture of the particulate source of heat, the carbonaceous material particles and the carrier gas. This resultant turbulent mixture is passed downwardly from the mixing zone to the pyrolysis zone of the pyrolysis reactor. In the pyrolysis zone the carbonaceous material feed is pyrolyzed to yield a pyrolysis product stream containing as solids, the particulate source of heat and a carbon containing solid residue of the carbonaceous material, and a vapor mixture of carrier gas and pyrolytic vapors comprising hydrocarbons. The pyrolysis product stream is then passed to a first separation zone such as one or more cyclone separators to separate at least the bulk of the solids from the vapor mixture.

The particulate source of heat is formed by transferring the separated particulate solids from the separation zone to at least one oxidation zone where a portion of the carbon in the solids is oxidized in the presence of an amount of free oxygen at least sufficient to raise the solids to a temperature sufficient for introduction to the pyrolysis zone. Preferably, oxidation occurs in two stages, the first involved during transport of the solids, and the second in a communicating oxidation stage. Of the total free oxygen fed, the amount of free oxygen introduced to the second stage is at least 50% of the molar amount of carbon monoxide entering the second stage.

The formed particulate source of heat and the gaseous combustion products of the solids are passed from the second oxidation stage to a second separation zone such as one or more cyclone separators. In the second separation zone the particulate source of heat is separated from the gaseous combustion products for feed to the chamber surrounding the upper portion of the pyrolysis reactor.

Preferably the second separation zone comprises at least two cyclone separation stages in series, where the bulk of the particulate source of heat is separated from the gaseous combustion products in a first cyclone separation stage. The remaining cyclone separation stages of the second separation zone serve to separate a fines fraction of the particulate source of heat from the gaseous combustion products. These separated fines are not used for the particulate source of heat. By not using this fines fraction for the particulate source of heat, there is less chance of fines contaminating the hydrocarbon mixture passing overhead from the first separation zone.

It also is preferred that the second oxidation zone and the first cyclone separation stage of the second cyclone separation zone be the same vessel, i.e., a cyclone oxidation-separation zone. This minimizes formation of carbon monoxide by allowing quick removal of the formed particulate source of heat from its gaseous combustion products, thereby increasing the thermal efficiency of the process.

In the process of this invention, short reaction time and low temperatures in the pyrolysis reaction zone enhance formation of the middle distillate hydrocarbons, i.e., hydrocarbons in the range of $C_5$ hydrocarbons to hydrocarbons having an end point of 950° F. As a consequence, it is preferred to conduct pyrolysis so that the residence time of the carrier gas in the pyrolysis section of the pyrolysis reactor and the first separator is less than about 5 seconds, and more preferably from about 0.1 to about 3 seconds. It also is preferred that pyrolysis be conducted at a temperature from about 900° to 1400° F. To achieve pyrolysis the solid particulate source of heat generally is introduced at a temperature from about 100° to about 500° F higher than the pyrolysis temperature to be achieved. The weight ratio of the particulate source of heat to the carbonaceous feed ranges from about 2 to about 20:1.

To provide turbulence to obtain rapid heat transfer from the particulate source of heat to the carbonaceous material, the turbulent mixture preferably has a solids content ranging from about 0.1 to about 10% by volume based upon the total volume of the stream.

The process of this invention has many advantages. Among these is improved process control because of a reservoir of the particulate source of heat behind the weir which dampens the effect of minor system upsets. Another advantage is that agglomerative coals can be processed with the process and apparatus of this invention because the turbulent flow in the mixing region can scour buildups of coal from the reactor walls. In addition, high yield of the valuable middle distillates can be obtained by operating the process under the preferred conditions.

Another advantage of the method and apparatus of this invention is that high thermal efficiencies are achieved because carbon monoxide formed by free oxygen in the transport gas reacting with carbon in the carbon containing residue in the first oxidation stage is oxidized in the second oxidation stage.

This invention also contemplates recovering hydrocarbon values from the vapor mixture. This is effected by progressively cooling the vapor mixture by directly contacting the vapor mixture with progressively cooler liquid coolant streams containing condensate of the vapor mixture.

These and other features, aspects and advantages of the invention will become apparent with respect to the following drawings, detailed description of the invention, and appended claims.

DRAWINGS

FIG. 1 schematically shows products obtained from pyrolysis of solid carbonaceous materials;

FIG. 2 schematically illustrates the overall process of this invention;

DETAILED DESCRIPTION

According to the present invention there is provided a totally integrated system for economical recovery of values from solid carbonaceous materials, and particularly from agglomerative as well as non-agglomerative coals. The system consists of the following major operations: a preparation operation, a pyrolysis operation, a recovery operation, and a gas cleanup operation.

First, definitions are presented followed by a description in general terms of the overall operations. Next, features of each major operation are detailed.

Figure 4:
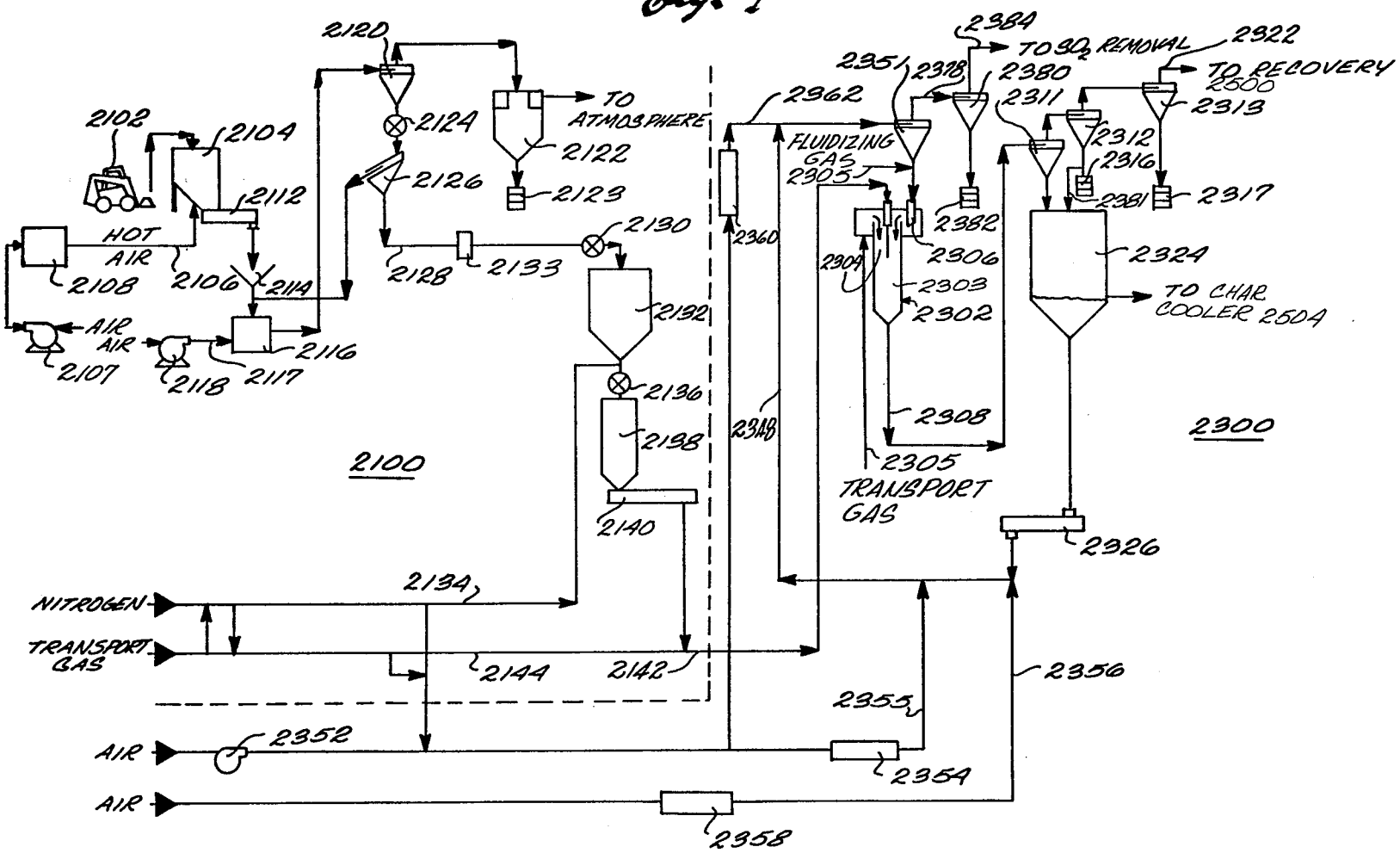
FIG. 4 illustrates details of a second preparation operation and a pyrolysis operation.
Figure 5:
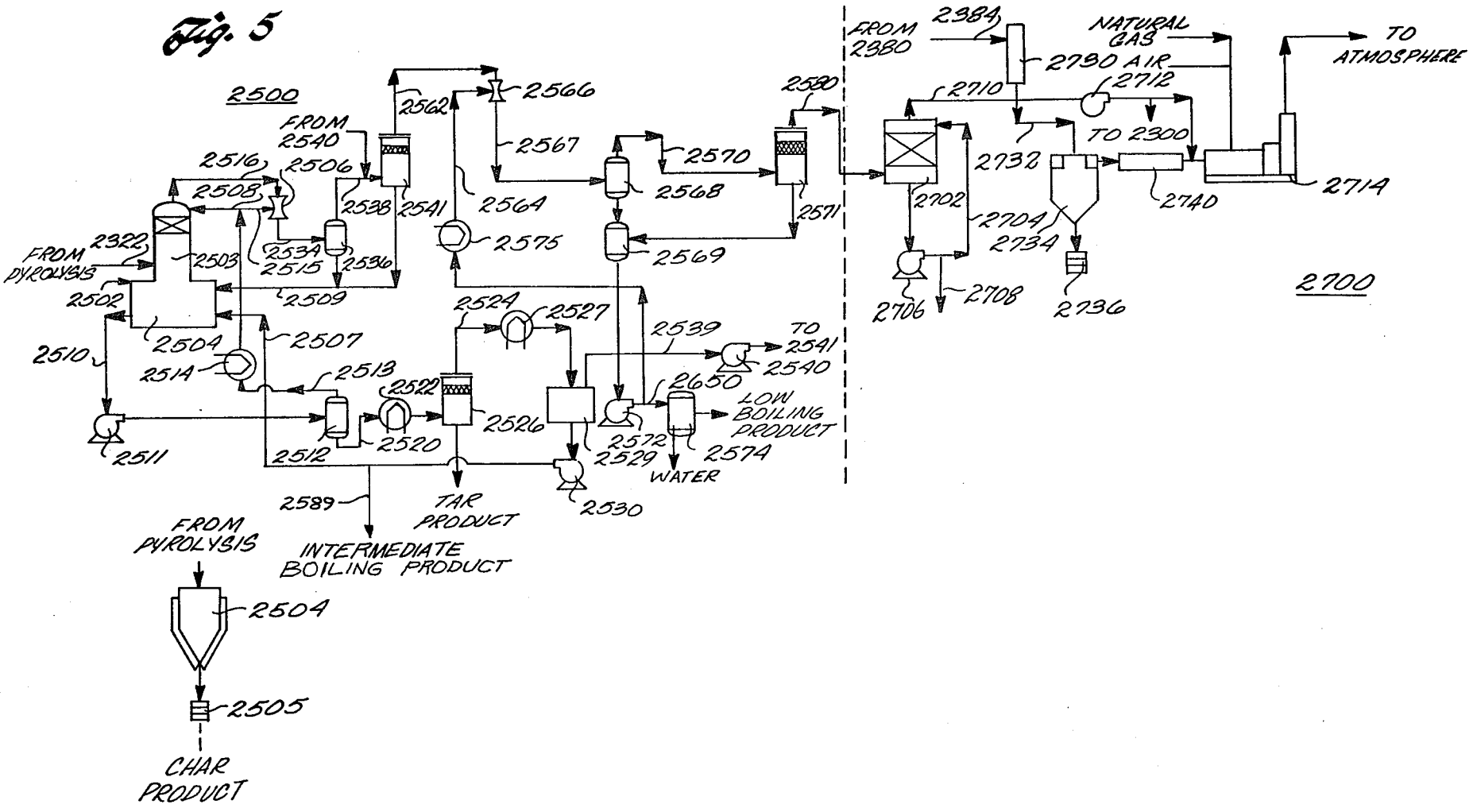
FIG. 5 depicts the details of a product recovery operation and a gas cleanup operation.

The attached drawings are to be considered jointly and where indicated sequentially for understanding the sequence of operations which comprises the invention. The operations shown in FIGS. 4 and 5 are sequentially joined to yield one version of the overall process.

A. Definitions

This section presents definitions useful in understanding the process of the present invention.

As used herein and in conjunction with the processing operations described, the term "comminution" refers to any physical act of size reduction, including, but not limited to chopping, crushing, and grinding by suitable machinery.

Figure 1:
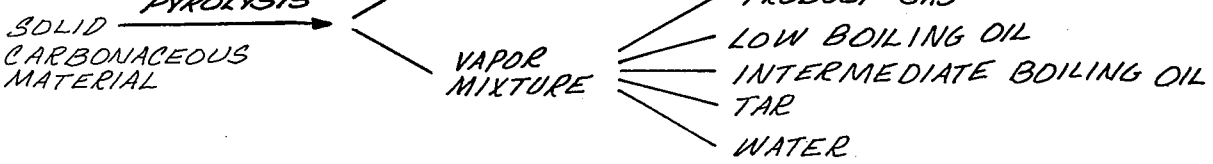

The terms defined in this section referring to effluent streams from a pyrolysis reaction zone can best be understood by reference to FIG. 1, which shows the relationship between the various streams. When a solid carbonaceous material is pyrolyzed there is formed a mixture of a carbon containing solid residue of pyrolysis and a vapor mixture. When coal is the carbonaceous material, "char" is the carbon-containing residue. "Char" is a combustible carbonaceous residue remaining after thermal distillation of volatiles from coal with attendant thermal cracking of the volatilized hydrocarbons. The vapor mixture contains "volatilized hydrocarbons", water, and nonhydrocarbon gases such as carbon monoxide and hydrogen resulting from the pyrolysis of coal.

By the term "volatilized hydrocarbons" there is meant the hydrocarbon containing gases produced by pyrolysis of a solid carbonaceous material. In general these consist of condensible hydrocarbons in vapor form which may be recovered by simply contacting the volatilized hydrocarbons with condensation means, and noncondensible gases or "product gas" such as methane and other hydrocarbon gases which are not recoverable by ordinary condensation means. The nonhydrocarbon gases end up in the "product gas," from which they can be removed by means such as chemical scrubbing.

Water is recovered from the vapor mixture while the condensible volatilized hydrocarbons are separated into three fractions, a "low boiling" fraction which typically consists of $C_4$ hydrocarbons up to constituents having a boiling point up to about 350° F, an intermediate boiling fraction containing constituents having a boiling point in the range of from about 250° to about 650° F, and a viscous "tar" fraction containing constituents having a boiling point greater than about 550° F. Some overlap in these boiling points is inevitable with conventional separation apparatuses. All boiling points presented herein are at atmospheric pressure.

A nondeleteriously reactive carrier or transport gas typically is used to carry the solid carbonaceous material particles to a pyrolysis reactor. By a "nondeleteriously reactive" gas there is meant a gas which is essentially free of free oxygen, although the constituents of the gas may react with pyrolysis products to upgrade their value. To be avoided are constituents which degrade pyrolysis products.

B. Overall Operations

Figure 2:
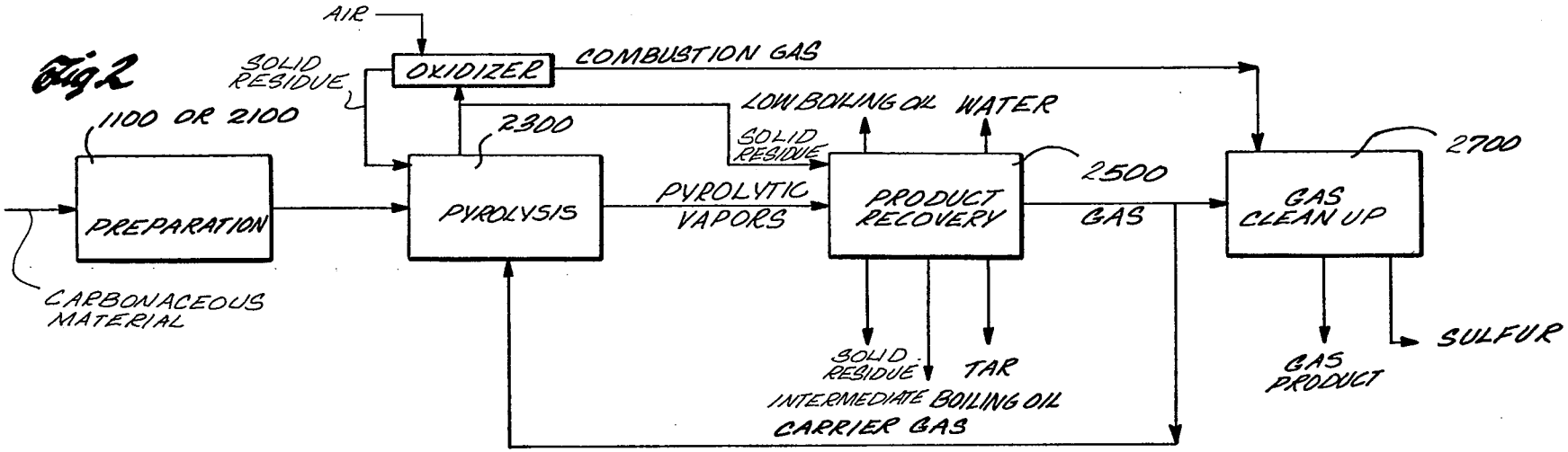

FIG. 2 schematically shows the overall process for recovery of values from solid carbonaceous materials.

The solid carbonaceous materials from which values may be recovered in accordance with this invention include uintaite, tar sands, oil shale, the organic portion of solid waste, particularly coal, in which terms this invention is described, and more particularly agglomerative coals, and the like, as well as mixtures thereof. All the various types of coal or coal like substances can be pyrolyzed. These include anthracite coal, bituminous coal, subbituminous coal, lignite, peat, and the like.

A solid carbonaceous material is introduced to a preparation operation 1100 (FIG. 3) or 2100 (FIG. 4) where it is initially comminuted to a particle size less than about 1000 microns, and in the case of an agglomerative coal, preferably to less than about 250 microns. Production of fines less than about 10 microns is minimized, and fines less than about 10 microns in diameter may be separated from the comminuted carbonaceous material to minimize carryover of the particulate residue of pyrolysis into the pyrolysis hydrocarbon product.

The solid carbonaceous material can optionally be fully dried or partially dried to leave some moisture in it for the generation of steam. The solid carbonaceous material is preferably partially dried to remove at least surface moisture to avoid the expenditure of heat energy for heating and vaporizing water in the pyrolysis zone.

Next, in a pyrolysis operation 2300 (FIG. 4) the solid carbonaceous material feed stream, a carrier gas which is substantially nondeleteriously reactive with respect to pyrolysis products, and a particulate heat source are combined under turbulent flow conditions in a flash pyrolysis zone. The flash pyrolysis zone is maintained at a temperature above about 600° F by the flow of the particulate heat source therethrough. The pyrolysis product stream from the pyrolysis zone includes carbon containing solid residue and a vapor mixture containing volatilized hydrocarbons. The carbon containing solid residue is separated from the pyrolytic vapor and at least a portion of the separated carbon containing solid residue is subjected to at least partial oxidation in the presence of a gas stream containing free oxygen to form the particulate source of heat for the pyrolysis operation and gaseous combustion products. Excess carbon containing solid residue beyond what is needed to form the particulate source of heat is withdrawn as product.

In a product recovery operation 2500 (FIG. 6) values are separated from the pyrolysis product stream. This is effected by condensing volatilized hydrocarbons as a low boiling fraction, an intermediate boiling fraction and tar from the vapor mixture. Water is decanted from the low boiling fraction.

Gases not condensed in the product recovery operation as well as the gaseous combustion products are cleaned up in a gas cleanup operation 2700 (FIG. 5) where sulfur compounds may be scrubbed from the gas. Carbon dioxide may also be scrubbed from the gas. A portion of the gas, either before or after cleaning, is recycled to the pyrolysis operation as a carrier gas. A portion containing uncondensed hydrocarbons can be recovered as a valuable gas product stream.

C. Preparation Operation

Figure 3:
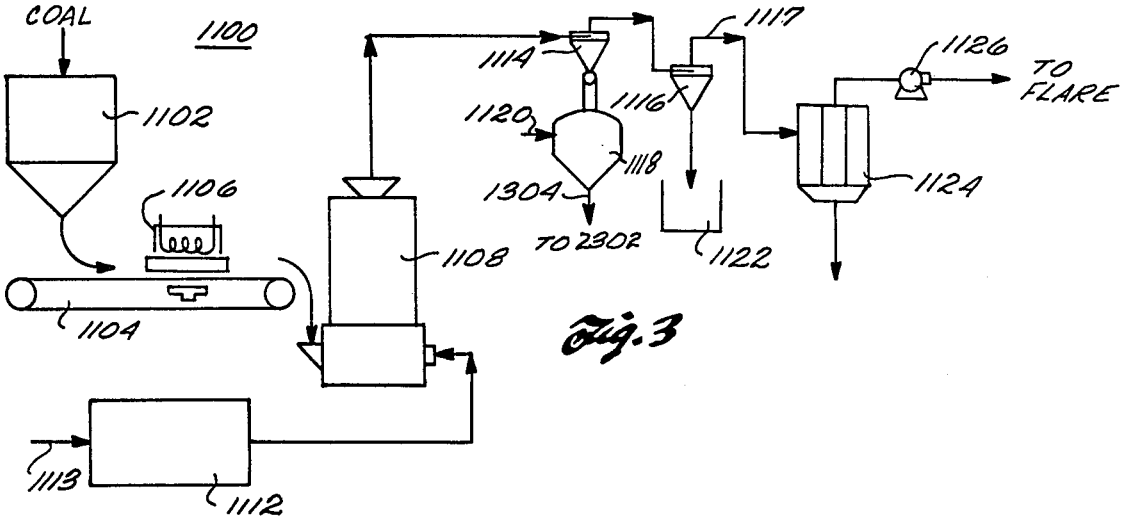
FIG. 3 illustrates the details of a first preparation operation.

FIG. 3 illustrates the details of preparation operation 1100. There is provided a feed bin 1102 to receive feed coal. The coal is dumped from the feed bin onto a weight scale conveyor 1104 which continuously carries the coal through a magnetic separator 1106 which removes from the coal feed magnetic particles such as loose metal parts which may damage downstream equipment. The weight scale conveyor 1104 senses the weight of the coal upon it, and automatically varies the speed of the conveyor to control the amount of the coal fed to the next stage of the process.

The conveyor 1104 dumps the coal into a single pass combination pulverizer-dryer stage 1108 such as a Raymond ball mill. The pulverizer-dryer 1108 comminutes the feed coal to a particle size of less than about 1000 microns to present a large surface to volume ratio to obtain rapid heating of the coal in the pyrolysis zone. Two comminution stages are required to comminute the coal to a particle size less than 1000 microns. Industrial grinding equipment is available which contains mechanically linked crushing and pulverizing stages. For an agglomerative coal, preferably the coal is comminuted to a particle size at least less than about 250 microns because agglomerative coals are well known to plasticize and agglutinate at relatively low temperatures, i.e., 400° to 850° F. An agglomerative coal should be rapidly heated through the plastic state before it strikes the walls of a pyrolysis reactor to prevent caking on the reactor walls. Since the rate at which a coal particle can be heated increases as particle size decreases, it is important that an agglomerative coal be comminuted to 250 microns or less, depending on the size and configuration of the pyrolysis reactor, so that substantially all the coal particles are not tacky by the time the coal particles strike a reactor wall. For example, when a bituminous high volatile C coal which agglomerates at temperatures above about 500° F is pyrolyzed in a 10 inch diameter pyrolysis reactor of the design shown in FIG. 8 and described below at a temperature of 1075° F, the coal is comminuted to a size less than 75 microns in diameter to prevent caking on the reactor walls. Coal particles larger than 75 microns in diameter would strike the reactor walls before passing through the plastic state.

Hot gas is blown by a heater-blower 1112 through the pulverizer-dryer 1108 to reduce the moisture content of the feed coal by removing at least the surface moisture so that the energy supplied to the pyrolysis reactor is not diverted into vaporizing water in the coal feed. Preferably some moisture is left in the coal since this increases the yield from the pyrolysis reaction. For example, high hydrocarbon product yield is obtained by leaving about 15% by weight water in subbituminous coal. Air, flue gas, or the effluent gas from a flare can be used as the gas stream 1113 heated in the heater-blower 1112. The hot gas carries the comminuted coal feed into a classifier such as a first stage feed coal cyclone 1114.

Generally, it is preferred to comminute the coal to a small size for rapid heating in a pyrolysis reactor. However, as the average size of the coal particles is decreased and as the limit on the largest particle size is lowered, more fines are produced.

It is important to minimize the amount of fine particles in the coal fed to the pyrolysis zone because fine coal particles have a tendency to be carried into and contaminate the liquid hydrocarbon products.

One method of minimizing the fines content of the coal feed stream is by removing fines from the coal feed stream by passing the coal feed stream to a cyclone separation zone comprising at least two cyclone stages in series. The bulk of the coal feed stream is separated in a first cyclone separation stage of the cyclone separation zone from a fine fraction of the coal feed stream which preferably contains substantially all of the coal feed stream smaller than about 10 microns in diameter. The stream separated in the first cyclone separation stage is for introduction to a pyrolysis zone. The fines fraction is recovered in the remaining cyclone separation stages of the cyclone separation zone.

This method is used in the process shown in FIG. 3 where in a first stage coal feed cyclone 1114 the larger coal particles are separated and dropped into a coal feed tank storage bin 1118. A portion of the fines, and preferably substantially all of the fines less than about 10 microns in diameter, are removed from the comminuted coal in this first stage cyclone and are carried overhead to a second stage feed cyclone 1116 along with the carrier flue gas.

In the second stage feed coal cyclone 1116, at least a portion of the coal particles fines from the feed coal in the first stage feed coal cyclone 1114 are separated from the carrier gas stream and collected in a receptacle 1122 for use as fuel. The carrier gas stream 1117 from the second stage feed coal cyclone 1116 is fed to a bag house 1124 where any entrained coal particles are removed from the gas stream. The gas is then blown by an exhaust fan 1126 to a flare stage (not shown) where combustible constituents are oxidized and then vented to the atmosphere.

In the case of agglomerative coal, it is preferred that the coal particles be maintained at a temperature below about 300° F in the coal feed tank 1118 to prevent their agglomeration.

In order to prevent the danger of a possible explosion in the pyrolysis reactor and to prevent the exposure of coal particles to oxygen sources to prevent oxidizing of the coal, since such exposure has a deleterious effect on yields from the process, a gas which is nondeleteriously reactive with respect to pyrolysis products is fed into the coal feed bin via line 1120 to blanket the coal in the feed bin. This gas also aerates the coal to allow it to flow from the coal feed bin 1118 to the pyrolysis zone.

To the left of the dotted line in FIG. 4 the details of coal preparation operation 2100 are shown. There is provided a coal storage and transfer area where coal transport units 2102 are continuously employed to deposit coal for processing for the recovery of the values contained therein. The coal is dumped into a raw coal bin 2104. The coal is fluidized and dried in the bin 2104 by a flue gas stream from the gas cleanup operation 2700 (FIG. 5) or by a hot air stream 2106 obtained by blowing air with a blower 2107 through a heater 2108. Preferably the coal is dried to the same moisture content as it is dried in the 1100 coal preparation operation described above.

The coal is dumped from the bin 2104 onto a conveyor 2112 which carries the coal to a crusher 2114 and thence to a pulverizer stage 2116. Preferably the pulverizer is operated so that a portion of the coal is comminuted to a size above the upper target size in a single pass through the pulverizer to reduce fines formation and reduce energy consumption during comminution. For example, when the upper limit on the particle size of the coal is 75 microns the pulverizer is operated to leave at least 5% by weight of the coal at a particle size greater than about 75 microns in in diameter. This is effected by comminuting the coal so that from about 70 to about 95% and preferably from about 80 to about 95% of the coal by weight is comminuted to a size less than 75 microns in diameter. It has been found that if all the coal is reduced to a size less than 75 microns in a single pass through the pulverizer 2116, excessive fines are produced, which subsequently must be withdrawn to prevent fine coal particles from being carried into the liquid hydrocarbon products of the coal.

The coal is transported from the pulverizer 2116 by a flue gas stream or an air stream 2117 produced by a compressor 2118 to a pulverized coal feed classifier such as a cyclone 2120 where a portion of the fines less than about 10 microns in diameter are carried overhead by the air stream to a bag house 2112 where the fines are separated from the transport gas which is vented to the atmosphere. The fines are collected in a container 2123 and can be used as boiler feed. The larger coal particles pass from the cyclone 2120 via solids conveyor means such as a rotary lock valve 2124 into a mechanical classifier such as a vibrating screen 2126. The rotary lock valve prevents the air in the coal comminution system from entering the comminuted coal storage area, and possibly the pyrolysis reactor where an explosion could occur. The screen 2126 separates oversized coal particles greater than the upper limit on the particle size of the coal from the remainder of the comminuted coal. The oversized coal is recycled to the pulverizer 2116. The remainder of the coal, which has a particle size less than the upper limit on the particle size and greater than about 10 microns drops via line 2128 into a conveyor such as a bucket or elevator conveyor or a rotary valve 2130 which carries the coal to a pulverized coal feed bin 2132. A sample point 2133 can be positioned in line 2128 to monitor the particle size distribution of the pulverized coal so that the operation of the pulverizer 2116 can be adjusted to prevent fines from entering the coal feed bin.

The pulverized coal storage bin 2132 preferably is maintained under an atmosphere free of oxygen by bleeding in a gas such as nitrogen or transport gas via line 2134 to prevent oxidation of the coal. Oxidation of coal has a deleterious effect on yields from the process, and leakage of oxygen into the pyrolysis reaction zone can result in an explosion and adversely effect process yields. From the pulverized coal feed bin 2132 the coal is transported via solids conveyor means such as a rotary valve 2136 into a feeder hopper 2138 utilized to prevent upsets in the coal preparation operation from affecting the pyrolysis operation. The feeder hopper 2138 also preferably is maintained under an oxygen free atmosphere. Preferably during the entire coal preparation operation the coal is not exposed to temperatures above about 300° F to prevent agglomeration of the coal particles when an agglomerative type coal is being processed.

The comminuted coal in the feeder hopper 2138 is fed at a desired rate by a feeder such as a gravimetric feeder or a screw feeder 2140 into the reactor feed transport line 2142. The coal feed is carried by a transport gas stream 2144 to the pyrolysis reactor 2302 in the pyrolysis operation. The transport gas is nondeleteriously reactive with respect to pyrolysis products. The transport gas can be a portion of the gas generated in the pyrolysis reactor 2302 and recovered in the product recovery operation 2500. Other nondeleteriously reactive gases such as nitrogen and steam may also be used.

D. Pyrolysis Operation

To the right of and below the dotted line in FIG. 4, the pyrolysis operation 2300 is depicted in detail. In this operation the comminuted coal is converted to form char and volatilized hydrocarbons.

With reference to FIG. 4 the comminuted dried coal with its transport gas is conveyed via line 2142 into a mixing region 2304 of a pyrolysis reactor 2302. Simultaneously with the introduction of the coal into the reactor, there is introduced a particulate heat source along with its transport gas stream 2305 via fluidized duct or standpipe 2306. This particulate heat source is a material capable of transferring heat to the coal to cause its pyrolysis into volatilized hydrocarbons and char. The heat source employed preferably is the solid product resulting from pyrolysis of the carbonaceous material, such as char or coke, or, in the instance of municipal solid waste, the glass-like inorganic residue resulting from the decarbonization of the solid residue of pyrolysis. The preferred heat source when coal is the solid carbonaceous material is char obtained from the devolatilization of coal in the pyrolysis reactor.

The particulate source of heat serves to prevent agglomeration and to provide at least a portion of the heat required for pyrolysis. The selection of the mass ratio of the hot particulate char to the coal particles depends upon the heat transfer requisites of the system, the tendency of the coal particles to agglomerate, and the amount of the heat of pyrolysis which is supplied by the carrier gas. The temperature, flow rate, and residence time in the reactor depend upon the particular system undergoing pyrolysis. In general, for economy sake, it is preferred to utilize char particles produced by the pyrolysis of the coal as the main source of heat.

The reactor 2302 is operated, depending upon the temperature and the nature of the particulate heat source, at a temperature of from between about 600° F and the introduction temperature of the particulate heat source. The reactor temperature is sustained essentially by the particulate heat source.

In the pyrolysis reactor, heat transfer occurs primarily by a solid-to-gas-to-solid convective mechanism with some solid-to-solid radiative and conductive heat transfer occurring.

The transport gas for both the coal and the particulate heat source can be the gas resulting from the pyrolysis of the coal either before or after condensible hydrocarbons are recovered and compounds such as hydrogen sulfide are scrubbed from the gas. Another carrier gas is synthesis gas, especially a hydrogen enriched carrier gas. To obtain maximum utilization of the particulate heat source, the transport gas for the particulate heat source can have a temperature approaching the particulate heat source's temperature.

The operating pressure of the pyrolysis reactor is usually above atmospheric pressure. As the pressure is increased, compression of the carrier gas and the volatilized hydrocarbons results. This allows use of lower volume downstream separation equipment.

Generally, high solids content in the pyrolysis feed stream is desired to minimize equipment size and cost. However, preferably the pyrolysis reaction zone is operated under the conditions described in U.S. Pat. No. 3,736,233, issued to Sass et al. and assigned to the assignee of this invention. According to the method of this patent, the pyrolysis feed stream preferably contains sufficient carrier gas that the feed stream has a low solids content ranging from about 0.1 to 10% by volume based on the total volume of the stream to provide turbulence for rapid heating of the coal and to dilute the coal particles and help prevent them from agglomerating, particularly when processing agglomerative coals. Rapid heating results in high yields and prevents agglutination of agglomerative coals. The solids in the pyrolysis feed stream are divided between coal and char with a char to coal weight ratio of from about 2 to about 20:1. The high ratio of char to coal helps prevent agglomerative coal particles from sticking together. The particulate char has a temperature consonant with the requirements of the pyrolysis zone, depending on the coal and carrier gas temperatures, and the mass ratios of the coal, char and carrier gas. At the above char to coal ratios, the temperature of the particulate char is typically about 100° to about 500° F higher than the pyrolysis zone temperature.

The temperature in the reaction zone is from at least about 600° to about 2000° F. It has been found that the type of product and total yield of product are highly dependent upon the temperature in the reaction zone. As the temperature in the reaction zone increases above about 1400° F the volatilized hydrocarbons from the pyrolysis reaction contain increasing amounts of noncondensible product gas. Preferably the particulate coal is heated to a temperature from about 900° to about 1400° F, and optimumly to about 1075° F to produce high yields of volatilized hydrocarbons containing a high percentage of valuable middle distillates. Middle distillates are the middle boiling hydrocarbons, i.e., $C_5$ hydrocarbons to hydrocarbons having an end point of about 950° F. These hydrocarbons are useful for the production of gasoline, diesel fuel, heating fuel, and the like.

The maximum temperature in the pyrolysis reactor is limited by the temperature at which the inorganic portion of the source of heat or the carbonaceous material softens with resultant fusion or slag formation. Since the particulate source of heat is normally at a higher temperature than the carbonaceous material, its softening temperature is usually the limiting factor. A pyrolysis temperature of 2000° F is about the maximum that can be achieved without slag formation.

The pyrolysis time in the reaction zone depends upon a variety of factors such as the temperatures of the components, nature of the coal feed, etc. The residence time in the reaction zone preferably is less than about 5 seconds, and more preferably from about 0.1 to about 3 seconds to maximize the yield of volatilized hydrocarbons, with longer residence times at lower pyrolysis temperatures. Longer pyrolysis times can lead to cracking of the volatilized hydrocarbon produced during pyrolysis, with reduced yield of condensible hydrocarbons.

As used herein, "pyrolysis time" means the time from when the coal contacts the particulate source of heat until the pyrolytic vapors produced by pyrolysis are separated from the spent particulate source of heat. A convenient measure of pyrolysis time is the average residence time of the carrier gas in the pyrolysis section of the pyrolysis reactor and the cyclone separators downstream of the reactor. Sufficient pyrolysis time must be provided to heat the coal to the pyrolysis temperature.

Apparatuses useful for combining the char and the transportable coal at the reactor inlet are shown in FIGS. 6–9. Using such apparatuses, the char and coal streams are intimately mixed under turbulent flow conditions to ensure efficient pyrolysis reaction and good heat transfer from the hot particulate char to the coal feed stream. These apparatuses are particularly useful for agglomerative coals because turbulent flow of char allows rapid heating of the coal, which prevents buildups of carbonaceous material on the reactor walls.

Figure 6:
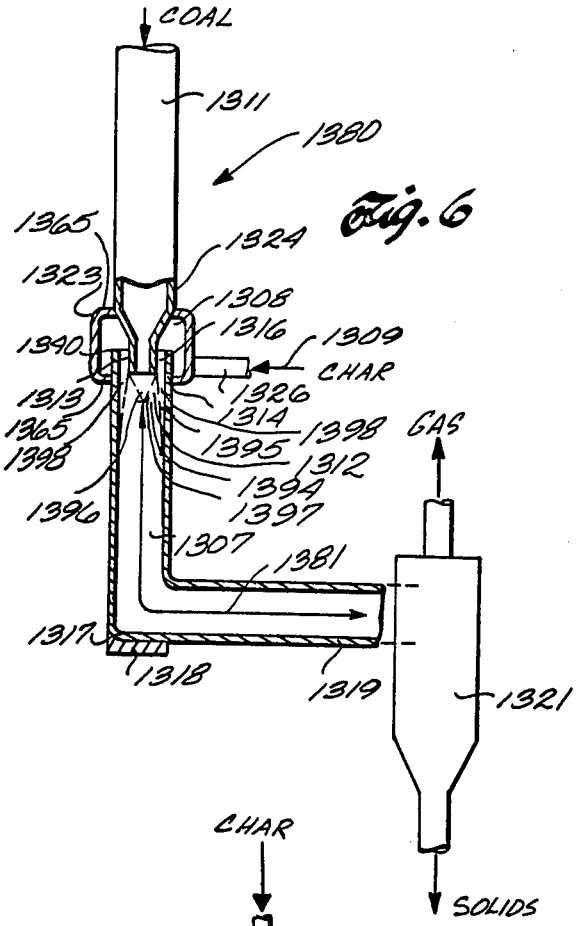
FIGS. 6–9 are elevational views, partly in section, of pyrolysis reactors useful for practicing this invention.

With reference to FIG. 6, the coal feed stream contained in a carrier gas enters a substantially vertically oriented mixing section 1312 of a substantially vertically oriented, descending flow pyrolysis reactor 1380 through a generally upright, annular first inlet 1311, terminating within the mixing section and constricted at its end 1313 to form a nozzle so that a fluid jet is formed thereby. Pyrolysis reactor 1380 is annular and has an upper end 1314, which is an open end of larger diameter than the nozzle 1313, thereby surrounding the nozzle and leaving an annulargap 1316 between the upper end 1314 of the reactor and the nozzle 1313. The reactor has an elbow 1317 in the middle which rests upon a support 1318. The lower end 1319 of the reactor terminates in a reactor product stream cyclone 1321 which separates the gaseous pyrolysis effluents from the solid pyrolysis effluents. An annular fluidizing chamber 1308 is formed by a tubular section 1323 with an annular rim 1365 connected to the first inlet wall 1324 directly above where the wall constricts to form the nozzle 1313 and the upper portion of the reactor. The chamber 1308 surrounds the nozzle 1313 and a portion of the upper end 1314 of the reactor.

A second annular inlet 1326 is generally horizontally connected to the annular fluidizing chamber 1308, therefore receiving a fluidized stream of char. The second inlet 1326 preferably is tangentially positioned with respect to the annular chamber wall to impart a swirl to the incoming stream. Preferably the second annular inlet discharges char into the fluidizing chamber below the top edge 1340 of the reactor so that incoming char builds up in the fluidizing chamber 1308 and is restrained by the weir formed by the upper end 1314 of the reactor to form a solids seal. The char is maintained in a fluidized state in the chamber 1308 by a fluidizing or aerating gas which is substantially nondeleteriously reactive with respect to pyrolysis products fed through inlet 1326 into the chamber. The char in the chamber 1308 passes over the upper end of the overflow weir and through the opening 1316 between the weir and the nozzle into the mixing section of the reactor. The advantage of this weir-like configuration is that an essentially steady flow of fluidized char enters the mixing section because the mass of the char backed up behind the upper end 1314 of the reactor dampens minor fluctuations in the char flow.

In the mixing zone of the pyrolysis reactor, the carbonaceous material contained in the carrier gas is discharged from the nozzle as a fluid jet 1394 expanding towards the reactor wall at an angle of about 20° or less as shown by dotted lines 1395 representing the periphery of the fluid jet. Once the particulate source of heat is inside the mixing section, it falls into the path of the fluid jet 1394 and is entrained thereby, yielding a resultant turbulent mixture of the particulate source of heat, coal feed, and the carrier gas. The jet has a free core region 1396 of coal, as delineated by the V-shaped dotted line 1397 in FIG. 6, extending considerably into the reactor. In the region 1398 between the reactor walls and the fluid jet 1394 there is unentrained particulate source of heat. The particulate source of heat along the periphery 1395 of the fluid jet preferably heats the carbonaceous material in the case of an agglomerative coal through the tacky state before the coal strikes the reactor walls. This mixing of the particulate source of heat with the solid carbonaceous material in the mixing zone initiates heat transfer from the particulate solid source of heat to the coal, causing pyrolysis to occur in a substantially vertically oriented pyrolysis section 1307 of the pyrolysis reactor.

Figure 7:
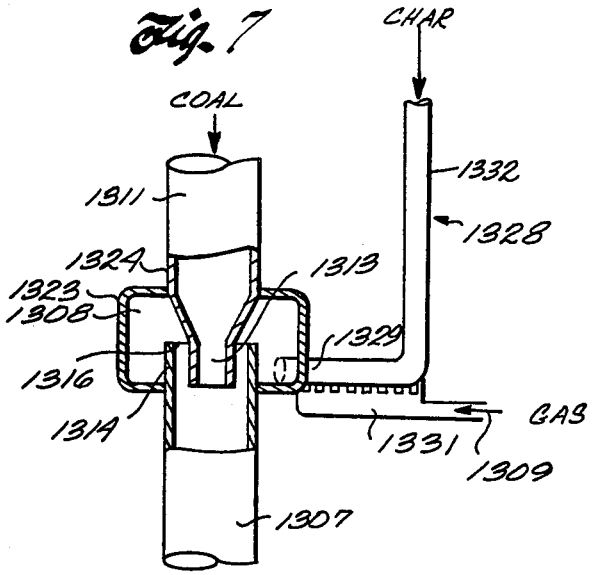

In FIG. 7, the apparatus is the same as that in FIG. 6 except for the second annular inlet 1328 which has a generally horizontal portion 1329 which is equipped with an air slide 1331. The air slide 1331 preferably operates on a transport gas stream 1309 resulting from the pyrolysis of the coal as a fluidizing gas stream. The inlet for the char also has a generally upright portion 1332 through which char is introduced and which communicates with the horizontal portion 1329. Char so vertically introduced is fluidized by the transport gas stream 1309 before its introduction into the fluidizing chamber 1308.

Figure 8:
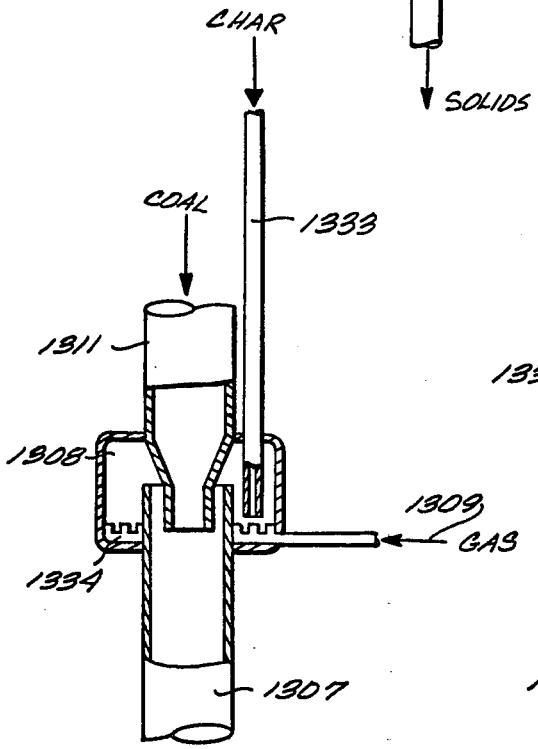

In FIG. 8 the apparatus is the same as in FIG. 6 except that the second annular inlet 1333 for introducing char comes generally vertically instead of horizontally into the fluidizing chamber 1308 and in that a porous bed or plate 1334 has been provided as the bottom of the chamber and has been connected to a source of recycle or carrier gas 1309 adapted to operate thereon in order to fluidize said incoming char by injecting the char with gas. The configuration of this apparatus is preferred and is the same as that of the pyrolysis reactor shown in FIG. 5.

Figure 9:
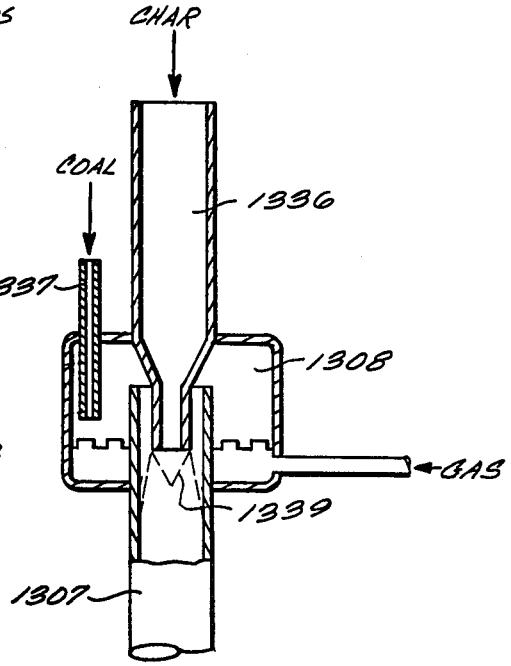
Figure 10:
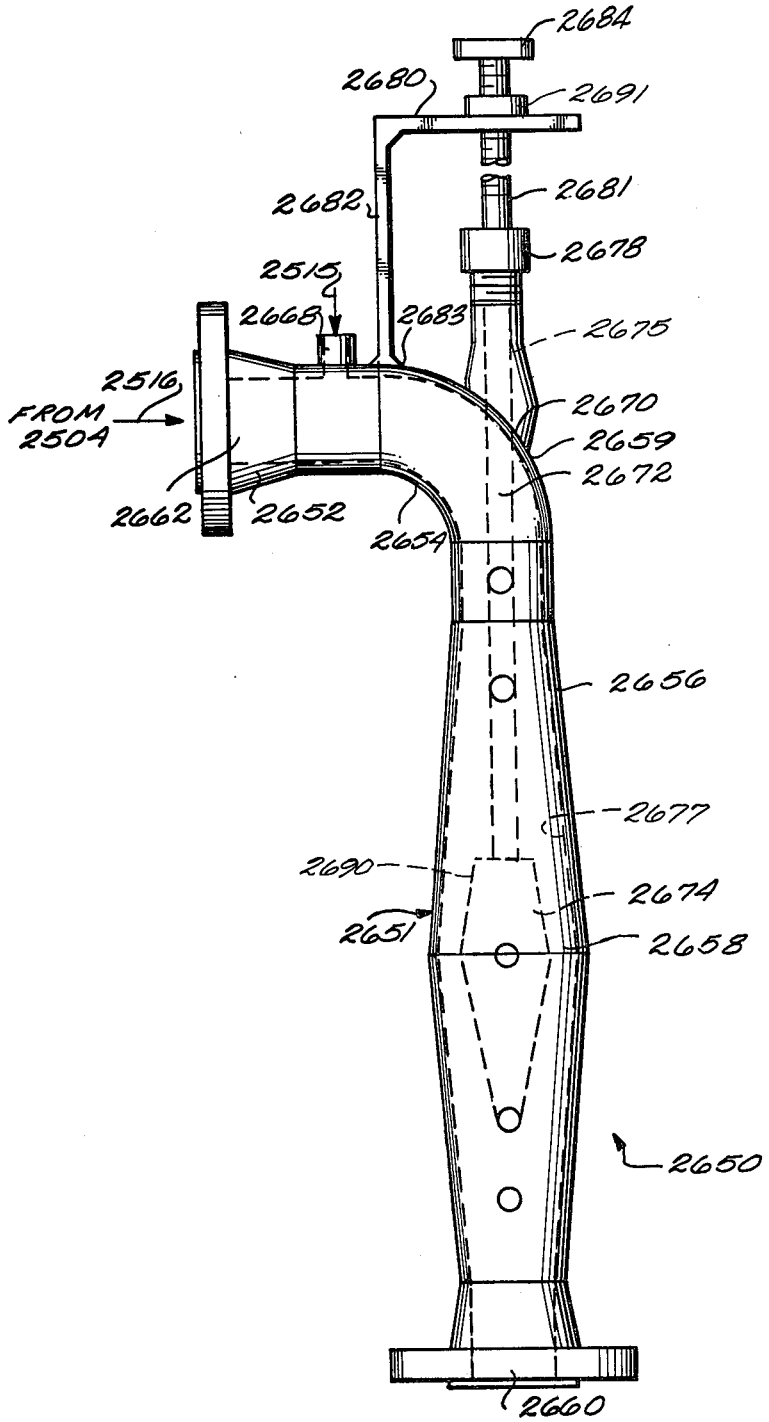

In FIG. 9 the apparatus is similar to that of FIG. 8 except that the char stream is introduced through the first inlet 1336 instead of the coal stream, the coal stream being introduced generally vertically instead to the fluidizing chamber via an upright second inlet 1337. This configuration is suitable only for nonagglomerative coals. The flow paths of the char and coal streams are the opposite of what they are in FIG. 8. The char stream in FIG. 9 is introduced rapidly enough to form a jet stream which acts upon the coal stream as shown by the broken lines 1339, like in FIG. 8.

Similarly, the char may be introduced through the first inlet and a noncaking coal may be introduced through the second inlet in FIGS. 6 and 7.

An advantage of the aparatuses shown in FIGS. 6–8 is that the coal is heated rapidly in the case of agglomerative coals, so that the tacky or sticky phase is thereby gone through rapidly enough to prevent the coal particles from sticking together and plugging the reactor.

Preferably in the apparatuses shown in FIGS. 6–9, the stream of particulate matter, either coal or char, which enters through the second inlet is maintained at a rate of flow less than turbulent and the particulate stream entering via the first inlet is maintained under turbulent flow at a rate sufficiently high that the resulting mixture stream from the contacting of the two inlet streams is under turbulent flow. Turbulent flow results in intimate contact between the coal and char particles, thereby yielding rapid heating of the coal by the char, which improves yields. In the case of an agglomerative coal, buildups of tacky coal particles on the reactor walls are prevented by rapid heating of the coal particles due to the turbulent flow. As used herein turbulent means the stream has a Reynolds flow index number greater than about 2000. The Reynolds number is based on the carrier gas at operating conditions. Laminar flow in the pyrolysis reactor tends to severely limit the rate of heat transfer within the pyrolysis zone. Process parameters such as the nozzle diameter and mass flow rate of the particulate matter and its carrier gas are varied to maintain the flow rate of the particulate stream entering the first inlet into the turbulent mixing region.

Preferably the nozzle 1313 is protected from wear by being refractory-lined, or it may be lined with any conventional material such as annealed stainless and cast steels, and the like.

The end of the coal feed inlet preferably is cooled as by water when pyrolyzing an agglomerative coal because the inlet can be heated above the point at which the coal becomes tacky due to heat transfer from the particulate source of heat surrounding the end of the solids feed inlet.

Although the Drawings show a solids feed inlet having a nozzle at the end to achieve high inlet velocities into the mixing regions, a nozzle at the end of the inlet is not required. Alternatively, the carbonaceous material and its carrier gas can be supplied at a sufficient velocity to the inlet so that the resultant mixture is under turbulent flow without need for a nozzle.

Referring to FIG. 4, the coal feed stream, char from standpipe 2306, and the nondeleteriously reactive carrier or transport gas stream 2305 are combined in the mixing region or zone 2304 to form a pyrolysis feed stream which is then reacted in a pyrolysis reaction zone 2303 to yield a pyrolysis product stream containing as solids, the particulate source of heat and char as the carbon containing solid residue of pyrolysis, and a vapor mixture. The vapor mixture contains carrier gas fed to the pyrolysis reaction zone, and products of pyrolysis such as carbon oxides, water vapor, hydrogen sulfide and volatilized hydrocarbons.

Hydrogen can be introduced into the pyrolysis reaction zone to upgrade the value of the hydrocarbon products by hydrogenation of unsaturated carbon-tocarbon bonds, denitrogenation, desulfurization, and the like.

The solids in the pyrolysis reactor product stream 2308 are separated from the vapor in a first cyclone separation zone or stage comprising three cyclone 2311, 2312, 2313, in series. The primary cyclone separator 2311 is a medium efficiency separator which removes most of the char particulates from the gas stream. Most of the finer particles are separated in the high efficiency secondary 2312 and tertiary 2313 reactor cyclones, and collected in bins 2316 and 2317, respectively. A portion of the fines can go overhead with the vapor mixture 2322 for the tertiary cyclone. The char in bins 2316 and 2317 may be used for boiler feed. By removing the char fines separated in the second 2312 and tertiary 2313 cyclone stages from the circulating char system used to heat the pyrolysis reactor 2302, the amount of circulating fines in the char system is decreased. This is important in minimizing the quantity of char fines being introduced to the first cyclone separation zone, thereby minimizing the quantity of fines going overhead from the tertiary reactor cyclone 2313 and contaminating the tar product.

Preferably the char collected in lines 2316 and 2317, along with particulate source of heat fines collected in line 2382 as described below, represent the net production of solids of the process. Thus as coal is pyrolyzed to produce char, fines are selectively withdrawn from the char inventory while larger char particles are left in the char combustion loop to form the particulate source of heat. This helps prevent contamination of the hydrocarbon product with fines carried over from the tertiary reactor cyclone 2313. If more char passes overhead from the primary reactor cyclone 2311 than is produced during pyrolysis of the coal, a portion of the char separated by the secondary cyclone can be diverted via line 2381 into the char surge bin 2324.

The vapor mixture 2322 from the tertiary cyclone is sent to a product recovery operation. The char separated by the primary reactor cyclone 2311 drops into a char surge bin 2324 to be pneumatically carried through the char combustion loop.

The bed of char in the surge bin 2324 is static. The pressure required for feeding the circulating char from the surge vessel 2324 to the reactor 2302 is provided by the static pressure of char in the surge bin and compaction provided by a screw feeder 2326. It is important that the screw feeder 2326 deliver a steady flow rate of char with a constant bulk density into the conveying gas stream to prevent upsets of the pyrolysis reaction zone.

At least a portion of the heat required for the pyrolysis operation is obtained by subjecting at least a portion of the separated char to at least partial oxidation in the presence of a source of oxygen such as air in an oxidation zone. The screw feeder 2326 compacts and conveys the char at a controlled feed rate into a transport line or riser 2348. The char is carried in the transport line 2348 is a transport gas to a cyclone combustion or oxidation-separation zone 2351.

The transport gas preferably contains free oxygen, and combustion during transport generates carbon monoxide. Other reactants which lead to the formation of carbon monoxide may also be present. These include steam and carbon dioxide. When steam is present, hydrogen also is formed.

In the preferred process, the transport gas contains, as indicated, some oxygen to generate a portion of the heat necessary to raise the char to the temperature required for feed to the pyrolysis reactor. However, the amount of oxygen is limited, for if there is too much oxygen in the transport gas, the carbon monoxide generated in the transport line could not be converted to carbon dioxide in the second oxidation stage without introducing so much additional oxygen to the second oxidation stage that the char would be raised to a temperature too high above the temperature required for feed to the pyrolysis reactor.

With reference to FIG. 4, the transport gas can be a hot air stream mixed with a diluent gas essentially free of free oxygen such as nitrogen or a transport gas obtained from the noncondensible fraction of the volatilized hydrocarbons resulting from the pyrolysis of the coal, or simply flue gas. The diluent gas is added to the hot air to provide sufficient gas velocity to convey the char to the oxidation zone. The hot air stream is obtained from a compressor 2352 which blows air through an air heater 2354 and into the transport line 2348 via line 2355. For startup purposes, hot gas obtained by burning natural gas in the presence of air in a gas generator 2358 is added through line 2356 to the char to provide sufficient heat for pyrolysis.

The oxygen in the air reacts exothermically with carbon in the char to produce gaseous combustion products including carbon monoxide. Thus the transfer line 2348 serves as a first oxidation stage for oxidizing the char to form the particulate source of heat while the cyclone oxidation-separation zone 2351 serves as a second oxidation stage. The gaseous combustion products and the transport gas transport the solids to the cyclone oxidation-separation stage 2351. The amount of free oxygen fed to the second oxidation stage of cyclone oxidation-separation stage 2351 at least equals 50% of the molar amount of carbon monoxide entering the stage. The total oxygen feed is at all times sufficient to raise the solids to the temperature required for feed to the pyrolysis zone. The remaining heat required preferably is obtained by taking some of the air compressed by a compressor 2352, heating the compressed air in a heater 2360 and feeding the heated air via line 2362 to the cyclone oxidation-separation zone 2351, where it is combined with the partially oxidized char. In the oxidation zone 2351 a portion of the carbon present is oxidized to a higher oxidation state. The heated air can be introduced into the line 2348 carrying the char to the cyclone 2351 through a tube coaxial with line 2348.

Because the amount of oxygen introduced into the oxidation zone is at least the stoichiometric amount required to completely oxidize carbon monoxide generated in the transport line 2348, the total potential heating value of the char oxidized in the transport line is normally obtained. As required, oxygen above the stoichiometric amount can be added to react with the carbon in the char to heat the char to the temperature required to form the particulate source of heat for introduction into the pyrolysis zone.

The cyclone oxidation-separation zone 2351 is maintained at a temperature consonant with the temperature requirements of the pyrolysis reaction zone. Depending upon the weight ratio of the particulate source of heat to coal in the pyrolysis reaction zone, the combustion zone is maintained at a temperature from about 100° to about 500° F or more higher than the pyrolysis reaction zone.

Introducing oxygen to the char in two oxidation stages where the balance of the oxygen is introduced at the inlet of a cyclone serves to obtain maximum heating value from the carbon in the char by oxidation. When char is oxidized where there is less than stoichiometric amounts of oxygen and/or the residence time is long, then some of the carbon dioxide in the reaction product gases tends to react with the char to produce carbon monoxide. Thus in the first oxidation stage carbon monoxide is formed, probably by the reaction:

$$C + CO_2 \rightarrow 2CO$$

This is undesirable because more valuable char has to be burned to achieve desired char temperatures than if carbon dioxide were the only product. In the process shown in FIG. 4, net carbon monoxide formed is minimized and the carbon dioxide to carbon monoxide ratio maximized to maximize the amount of heat generated per unit amount of free carbon combusted.

An advantage of using a cyclone vessel for the oxidation zone is that the char is separated from the combustion gases and the oxygen in a very short time, thus selectively maximizing carbon dioxide production. Another advantage of using a cyclone vessel for reacting the char with an oxygen containing gas is that separation of the combustion gases from the char and combustion of the char are accomplished in the same vessel, the cyclone. This reduces capital and operating costs. Also, consumption of char is reduced at a given temperature. In addition, char particle fines, which are less valuable than the larger char particles, are burned preferentially because of the fast separation of the large particles in the cyclone.

When oxidizing char in a cyclone combustion-separation zone, preferably the residence time in the cyclone is less than about 5 seconds, and more preferably from about 0.1 to about 3 seconds to minimize carbon monoxide formation which occurs at longer residence times where there is more opportunity for carbon dioxide formed to react with char to form carbon monoxide according to the reaction $C + CO_2 \rightarrow 2CO$. Herein the term "residence time" as applied to a cyclone separation-combustion zone means the average residence time of the gas phase of the feed to the cyclone.

Instead of oxidizing the char to form the particulate source of heat, the char can be heated by an electrical or gas furnace or by heat exchanger means.

Referring to FIG. 4, the particulate source of heat is separated from the transport gas, non-reactive components of the oxygen source, and combustion gas in a second cyclone separation stage comprising the cyclone oxidation-separation zone 2351 and a char cyclone 2380. The bulk of the solids are separated in the cyclone combustion-oxidation zone simultaneously with the oxidation of the char. The gaseous overhead stream 2378 from the cyclone oxidation-separation zone 2351 flows into the char cyclone 2380 where char fines and any ash resulting from the complete oxidation of char are separated and dropped into a container 2382 for sale as boiler feed. Because these char particles are not sent to the reaction zone, the inventory of fines in the char loop is minimized and there is less chance of char particles going overhead from the tertiary reactor cyclone 2313 and contaminating the hydrocarbon product. The gas 2384 discharged from the secondary char cyclone 2382 is vented to a gas cleanup operation for purification before it is vented to the atmosphere.

The char recovered in the cyclone oxidation-separation stage 2351, which preferably is substantially free of fines less than about 10 microns in diameter, is introduced to the mixing section 2304 of the pyrolysis reactor 2302 through a fluidized duct 2306. A fluidized duct is used to ensure a steady flow of char into the annular mixing zone 2304. The fluidizing gas preferably is non-deleteriously reactive with respect to pyrolysis products.

The fluidized char duct or standpipe 2306 in combination with the char cyclone oxidation-separation 2351 is a self compensating system which tends to maintain a constant flow rate of char at a constant pressure to the reactor. For example, if fewer char particles are entering the mixing zone of the reactor, the level of char in the char duct 2306 increases, which tends to increase the static pressure of the char and thereby force more char into the reactor.

Surplus char produced by the pyrolysis reaction beyond what is removed by the secondary 2312 and tertiary 2313 reactor cyclones and the char cyclone 2380 is withdrawn from the char surge bin 2324 and sent to a product char bin in the product recovery operation.

In the process shown in FIG. 4 particulate contamination of the liquid hydrocarbons resulting from the pyrolysis of the coal is minimized because of four novel features. First, in the coal preparation operation the production of fines is minimized in the comminution step by initially comminuting the coal so that a portion of the coal is larger than the maximum particle size fed to the pyrolysis reactor. Second, fines produced during the comminution are separated from the coal. Third, in the pyrolysis operation, fines are removed from the char before subjecting the char to oxidation to prepare the particulate source of heat. And fourth, also in the pyrolysis operation, fines in the particulate source of heat are removed before feeding the particulate source of heat to the pyrolysis reaction zone. These four features may be used separately or jointly to reduce solid contamination of the liquid hydrocarbons.

E. Product Recovery Operation

The area to the left of the dotted line in FIG. 5 depicts the steps of the product recovery operation 2500. Char from the pyrolysis operation 2300 is cooled prior to sale such as by collecting the char in the product char bin cooler 2504 which is jacketed with cooling water to reduce the char temperature to levels which permit easy handling of the char. If the bed temperature in the cooler is maintained at a temperature higher than 212° F or a countercurrent flow of cooling water is used, steam can be generated while cooling the char. The char is collected in drums 2505 or other containers for sale as char product.

Hydrocarbon values are recovered from the pyrolytic vapor mixture stream 2322 by direct heat exchange in a gas/liquid contacting zone with a quench liquid. The gas/liquid contacting zone can be a spray tower, a venturi contactor, a gas absorption tower, or the like, or combinations thereof. In the version of this invention shown in FIG. 5, a wash tower 2502 and a venturi contactor 2506 operating at about the same temperature are used serially as first and second quench zones or contacting stages, respectively. The first quench stage 2502 has a top condensation or contacting section 2503 and a bottom liquid collection or mixing section 2504.

The pyrolytic vapor mixture comprises volatilized hydrocarbons, carrier gases used to convey carbonaceous material to the pyrolysis reaction zone, and non-hydrocarbon components such as hydrogen sulfide which may be generated in the pyrolysis reaction. The volatilized hydrocarbons have a wide range of boiling points ranging from methane with a boiling point of −259° F to heavy, viscous tars which carbonize before distilling.

In the process of this invention, three liquid hydrocarbon fractions are recovered from the pyrolytic vapor. These are the low boiling hydrocarbon fraction containing $C_4$'s to constituents having a boiling point up to about 350° F, the intermediate boiling hydrocarbon fraction containing constituents having a boiling point in the range of from about 250° to about 650° F, and the tar fraction containing constituents having a boiling point greater than about 550° F.

In the condensation section 2503 of the wash tower, the pyrolytic vapor mixture, which has a temperature of at about 600° F, is quenched and partially condensed by direct contact with a quench liquid 2508 to form a tar containing condensate and a partially condensed pyrolytic vapor stream from the vapor mixture. The quench liquid is a cooled liquid mixture consisting essentially of tars mixed with intermediate boiling hydrocarbons condensed from the pyrolytic vapor. The partially condensed pyrolytic vapor contains primarily lower boiling hydrocarbons of the vapor mixture and volatilized quench liquid. The combined liquid stream contains primarily higher boiling hydrocarbons of the quench liquid and condensate from the vapor mixture. The partially condensed pyrolytic stream 2516 from the wash tower 2502 is contacted with a portion 2515 of the quench liquid from the collection section of the wash tower in the first venturi contactor 2506 to scrub any entrained tars in the form of vapors and aerosols from the partially condensed pyrolytic vapor.

The scrubbed, partially condensed pyrolytic vapor stream is separated from the combined stream of the quench liquid and entrained tars scrubbed in the first venturi contactor in a gas/liquid separator vessel 2536 and then passed through line 2538 along with the vapors from the vacuum pump 2540 to a demister drum 2541 in which any additional entrained aerosols are separated for recycle to the wash tower. The overhead 62 from the demister drum 41 is the vapor residue. The second quench liquid stream and the separated aerosols contained in the second liquid stream are passed as stream 2509 to the wash tower 2502.

Condensate formed in the wash tower and the first venturi contactor and quench liquid from a combined liquid stream. The combined liquid is collected in the collection section 2504 of the wash tower 2502 and is then quickly mixed with a viscosity-lowering liquid or solvent such as intermediate boiling hydrocarbons condensed from the pyrolytic vapor to form a mixed liquid or condensate solution. The viscosity-lowering liquid is provided via line 2507 and is fed directly to the collection or mixing section of the wash tower. The viscosity-lowering liquid has a viscosity lower than the viscosity of the combined liquid stream, so that by mixing the combined liquid stream with the viscosity-lowering liquid a mixed liquid having a viscosity substantially lower than the viscosity of the tar containing condensate is produced.

Preferably sufficient quench liquid is provided to contact the vapor mixture and partially condensed pyrolytic vapor to form a mixed liquid having a temperature less than 700° F, and more preferably less than 500° F to prevent self-polymerization of the tars in the mixed liquid and degradation of the hydrocarbon product. In order to operate the process with economical levels of circulating quench liquid, preferably the mixed liquid is cooled down to a temperature above about 100° F, and more preferably above about 200° F.

The mixed liquid is withdrawn from the wash tower 2502 through line 2510 and pumped by pump 2511 into a surge tank 2512 from which two streams 2513, 2520 are withdrawn. A solids removal zone may be used to remove any solids entrained in the pyrolytic vapor mixture which drop to the collection section of the wash tower 2502 from the condensation section. Suitable solids removal techniques include agglomeration, precipitation, filtration, centrifugation, hydrocloning, and gravity sedimentation. The presence of the viscosity-lowering liquid in the combined liquid substantially reduces the viscosity of the combined liquid stream and thereby allows effective separation of solids from the combined liquid stream. Solids removal zones can also be used to remove solids from streams 2513 and 2520 respectively. Thus, solids can be removed from any or all of streams 2510, 2513, and 2520. In addition, the surge tank 2512 can be used to settle out solids from the mixed liquid. The valuable solids removed can be sold as fuel, or can be recycled to the pyrolysis operation where they can be oxidized to provide heat for pyrolysis.

A first portion 2513 of the mixed liquid is withdrawn from the surge tank 2512 and cooled in a cooling zone such as shell-and-tube heat exchanger 2514 to form the quench liquid, part of which is introduced as quench liquid streams 2508, 2515 to the condensation section 2503 of the wash tower 2502 and the first venturi 2506, respectively. The remainder of the mixed liquid is withdrawn as a second portion 2520 from the surge tank 2512 and passed to a separation zone in which a tar fraction is recovered from the mixed liquids, thereby yielding a substantially tar-free viscosity-lowering liquid stream. The tar fraction has a higher volume average boiling point than the viscosity-lowering liquid which consists primarily of intermediate boiling hydrocarbon solvent. Separation can be effected by distillation, or a vacuum flash system such as the one shown in FIG. 5 can be used for effecting the separation by distillation of the viscosity-lowering liquid from the tars. In this method, the second portion of the mixed liquid stream 2520 from the surge vessel 2512 is heated in a heat exchanger 2522 and then the viscosity-lowering liquid is flash vaporized from the tars in a vacuum flash zone 2526. The tars are separated from the bottom of the vacuum flash zone 2526 as tar product. After demisting in the vacuum flash zone or drum 2526 to remove entrained tars, a substantially tar-free stream 2524 is withdrawn from the flash drum 2526 and then partially condensed in a partial condenser 2527. The condensed liquid fraction from partial condenser 2527 is recovered in a separator 2529 and pumped by pump 2530 to the collection section 2504 of the wash tower 2502 as the viscosity-lowering liquid 2507. Excess viscosity-lowering liquid beyond the amount required in the wash tower 2502 is recovered an intermediate boiling hydrocarbon product via line 2589. The vapors 2539 from the separator 2529 are withdrawn by vacuum pump 2540 which provides the vacuum for the vacuum flash drum, and then sent to a demister drum 2541, as described above.

It is preferred that the separation of the tars from the viscosity-lowering liquid be effected using distillation under low pressure such as under vacuum, and at least lower than the pressure in the wash tower 2502, because separation can be effected at low temperatures at low pressures with minimal degradation of the tar product.

The distilled viscosity-lowering liquid may contain tar acids such as phenol, tar bases such as pyridine, and other valuable chemicals. These may be removed from the essentially tar-free viscosity-lowering liquid by well known methods, such as extraction. Removal of these valuable byproducts reduces consumption of hydrogen in subsequent hydrogenation operations described below because these byproducts tend to reach with hydrogen to form water and amonia.

Preferably the vacuum flash zone 2526 is operated so that only the lighter hydrocarbons are distilled and returned to the wash tower 2502, and not the heavier tar product. This is effected by operating the flash drum 2526 at a temperature close to the temperature in the wash tower, so that the heat load on the exchanger 2522 before the flash drum is small. Preferably the temperature rise across the exchanger is only from about 100° to about 200° F, and the vacuum in the flash drum is about 1 psia or less. This also reduces the heat load on the partial condenser 2527 downstream of the vacuum flash drum 2526.

The weight ratio of the viscosity-lowering liquid 2507 per pound of condensate formed in the wash tower 2502 and the first venturi contactor 2506 is from about 0.01 to about 500, and more preferably from about 0.1 to about 100. Typically the maximum loading of the circulating viscosity-lowering liquid is from about 0.5 to about 1.5 pounds of tar per pound of viscosity-lowering liquid. At solvent circulation rates less than about 0.01 pounds of viscosity-lowering liquid per pound of condensate, insignificant lowering of the viscosity of the condensate results. At a high circulation rate of the viscosity-lowering liquid, many substantial advantages are realized. First, the viscosity-lowering liquid washes pipes and equipment free of coke deposits. In addition, a high dilution resulting from high rates of the viscosity-lowering liquid improves the stability of the tars against self polymerization due to local hot spots and lowers the viscosity of the tars, thereby permitting easier handling of the viscous heavy tar. A high level of viscosity-lowering liquid also lowers the viscosity of the liquids in the wash tower 2502, and therefore allows the tower to be operated at a lower temperature, thereby minimizing thermal degradation and cracking of the tar which can occur at high temperatures.

However, at viscosity-lowering liquid circulation rates greater than about 500 pounds per pound of condensate found in the wash tower and the first contactor, the benefits realized are outweighed by the costs of pumping the high volumes of liquid and separating the viscosity-lowering liquid from the condensate.

Another advantage of using high viscosity-lowering liquid loadings is that the relatively nonviscous mixed liquid is easily subjected to solids removal. Thus char carried overhead with the pyrolytic vapors can be separated, thereby upgrading the quality of the tar product and allowing recovery of the valuable carbon containing solids.

Also, due to the dilution of the tar containing condensate, the tar in the mixed liquid is easily hydrogenated in a hydrogenation zone. The streams which can be hydrogenated are the mixed liquid condensate solution stream 2510 from the wash tower, the mixed liquid stream 2520 flowing to the separation zone, the mixed liquid stream 2513 cycled back to the wash tower, uncondensed viscosity-lowering liquid 2524 after pressurization from the vacuum flash drum 2526 in a vapor phase hydrogenation zone and condensed viscosity-lowering liquid. When solids removal is used, the mixed liquid streams 2510, 2513, and 2520 can be hydrogenated before or after solids removal, but preferably after since the solids tend to foul the hydrogenation apparatus and plug catalytic beds when used. Any one or combination of these streams can be hydrogenated. Hydrogenation is particularly effective when done in combination with solids removal because solids can poison and plug up catalyst beds, when used.

Hydrogenation can be effected catalytically or noncatalytically. A wide variety of catalysts can be used to catalyze the hydrogenation reaction. Among these are hydrocracking and hydrotreating catalysts, including compositions of cobalt, molybdenum, nickel and tungsten supported on silica-alumina or alumina bases. The recycle viscosity-lowering liquid stream 2507 is easily hydrotreated in a fixed bed because it is free of solids and porphyrins which reduce the activity of a hydrotreating bed. Because hydrogenated solvent may have hydrogen transfer capabilities, hydrogen may be transferred to unstable free radicals in the heavy tar condensed in the wash tower, thereby stopping undesirable polymerization reactions. This transfer of hydrogen can be accomplished in the collection zone of the wash tower, depending on the operating temperatures in the collection zone, or by heating and holding the mixed liquid at an elevated temperature and/or pressure.

Three separate streams, quench fluid 2508, the essentially tar-free viscosity-lowering liquid 2507, and the second quench liquid stream containing separated aerosols are introduced to the wash tower 2502. Alternatively, any two or all three of these streams can be combined and introduced together as one stream to the condensation section 2503 of the wash tower 2502. This has the advantage that low boiling hydrocarbons which may be present in the viscosity-lowering liquid are vaporized in the condensation section to pass overhead from the wash tower. When this scheme is used, the contacting and mixing steps occur simultaneously in a single contacting-mixing zone.

The essentially tar-free viscosity-lowering liquid stream 2507 can advantageously be introduced to the wash tower through instrumentation taps, thereby continuously purging the taps to prevent them from being plugged by heavy tars and solids entrained by the pyrolytic vapor.

The remainder of the product recovery operation shown in FIG. 5 is dedicated to recovery of low boiling hydrocarbons from the vapor residue from the demister drum 2541. The vapor residue which contains pyrolysis products such as uncondensed volatilized hydrocarbons including low boiling hydrocarbons, water, hydrogen sulfide, carbon dioxide, and carbon monoxide, is contacted with a circulating scrubbing solution 2565 in a second venturi contactor 2566 to coalesce the water and condensible hydrocarbons. The scrubbing solution is an oil water mixture containing from about 50 to about 70% water. The oil portion of the scrubbing solution is a cooled condensate of low boiling hydrocarbons condensed from the vapor residue in the venturi 2566. The liquid in the effluent stream 2567 from the scrubber 2566 is separated from the gases in a liquid/gas separator 2568 and then combined in a surge tank 2569 with liquids entrained by the gas stream 2570 from the separator which are removed in a demister 2571. The demisted gas stream 2580 from the demister 2571 is passed to the gas cleanup operation 2700. The liquids in the surge tank 2569 are withdrawn by a pump 2572 and a portion is cooled in a cooling zone 2575 and then used as the scrubbing solution 2564 in the venturi stage 2566 for contacting the incoming vapor residue. The remainder of the liquid in the surge tank of 2569 is decanted in a decanter stage 2574 into a water phase and a light oil phase. The water is withdrawn as water product and the light oil is withdrawn as low boiling hydrocarbon product.

What is claimed is:

1. A continuous process for recovery of values contained in solid carbonaceous materials which comprises the steps of:

(a) providing a feed stream containing a particulate solid carbonaceous material, a substantial portion of the paticulate solid carbonaceous material being of a particle size less than about 1000 microns in diameter;

(b) subjecting the particulate solid carbonaceous material to flash pyrolysis by continuously:

(i) transporting the particulate solid carbonaceous material containing feed stream contained in a carrier gas which is substantially nondeteriously reactive with respect to products of pyrolysis of the particulate solid carbonaceous material to a solids feed inlet of a substantially vertically oriented, descending flow pyrolysis reactor having a substantially vertically oriented pyrolysis zone operated at a pyrolysis temperature above about 600° F;

(ii) feeding a particulate source of heat at a temperature above the pyrolysis zone temperature to a substantially vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate heat source in said chamber being maintained in a fluidized state by the flow therewith of an aerating gas substantially nondeleteriously reactive with respect to products of pyrolysis of the particulate solid carbonaceous material;

(iii) discharging the particulate source of heat over said weir and downwardly into said mixing region at a rate sufficient to maintain said pyrolysis zone at the pyrolysis temperature;

(iv) injecting the particulate solid carbonaceous material feed stream and carrier gas from the solids feed inlet into the mixing region to form a resultant turbulent mixture of the particulate source of heat, the particulate solid carbonaceous material particles and carrier gas;

(v) passing the resultant turbulent mixture downwardly from said mixing zone to the pyrolysis zone of said pyrolysis reactor to pyrolyze the solid carbonaceous material particles and yield a pyrolysis product stream containing as particulate solids, the particulate source of heat and a carbon containing solid residue of pyrolysis of the particulate solid carbonaceous material, and a vapor mixture of carrier gas and pyrolytic vapors comprising volatilized hydrocarbons including tars;

(c) passing the pyrolysis product stream from said pyrolysis reactor to a separation zone to separate at least the bulk of the particulate solids from the vapor mixture; and (d) forming the particulate source of heat by:

(i) transporting the separated particulate solids from the separation zone to an oxidation-separation zone comprising at least two cyclone separation stages in series with a transport gas containing free oxygen with resultant carbon monoxide formation from the carbon in the particulate solids; and (ii) combining the transported particulate solids, carbon monoxide and transport gas in the first cyclone separation stage with a source of free oxygen in an amount at least equal to 50 mole percent of the carbon monoxide entering the oxidation stage, the total free oxygen in the transport gas and combined in the first cyclone separation stage being sufficient to raise the solids to a temperature above the temperature of the pyrolysis zone while simultaneously separating the bulk of the particulate source of heat from the gases in the first cyclone-separation stage to form the feed to the substantially vertically oriented chamber, the residence time in said first cyclone stage being less than about 5 seconds, and separating a fines fraction of the particulate source of heat from the gases in the remaining cyclone separation stages.

2. A process as claimed in claim 1 in which the pyrolysis temperature is from about 600 to about 2000° F.

3. A process as claimed in claim 1 in which the pyrolysis temperature is from about 600° to about 1400° F.

4. A process as claimed in claim 1 in which the pyrolysis temperature is from about 900° to about 1400° F.

5. A process as claimed in claim 1 in which a substantial portion of the particulate solid carbonaceous material are particles in the range from about 10 to about 1000 microns in diameter.

6. A process as claimed in claim 1 in which the solid carbonaceous material is an agglomerative coal and a substantial portion of the particulate solid carbonaceous material is of a particle size less than about 250 microns in diameter.

7. A process as claimed in claim 1 in which the particulate solid carbonaceous material is an agglomerative coal, and a substantial portion of the particulate solid carbonaceous material is of a particle size in the range from about 10 to about 250 microns in diameter.

8. A process as claimed in claim 1 in which the resultant turbulent mixture has a particulate solids content ranging from about 0.1 to about 10% by volume based on the total volume of the resultant turbulent mixture and a weight ratio of the particulate source of heat to solid carbonaceous material feed of from about 2 to about 20:1.

9. A process as claimed in claim 1 having a pyrolysis time of less than about 5 seconds.

10. A continuous process for recovery of values contained in solid carbonaceous materials comprising the steps of:

(a) providing a particulate solid carbonaceous material feed stream substantially containing particles of a size from about 10 to about 1000 microns in diameter;

(b) subjecting the particulate solid carbonaceous material to flash pyrolysis by continuously:

(i) transporting the particulate solid carbonaceous material feed stream contained in a carrier gas which is substantially nondeleteriously reactive with respect to products of pyrolysis of the particulate solid carbonaceous material to a solids feed inlet of a vertically oriented, descending flow pyrolysis reactor having a pyrolysis zone operated at a pyrolysis temperature of from about 600° to about 2000° F;

(ii) feeding a particulate source of heat at a temperature above the pyrolysis zone temperature to a vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate heat source in said chamber being maintained in a fluidized state by the flow therewith of an aerating gas substantially nondeleteriously reactive with respect to the products of pyrolysis of the particulate solid carbonaceous material;

(iii) discharging the particulate source of heat over said weir and downwardly into said mixing region at a rate sufficient to maintain said pyrolysis zone at the pyrolysis temperature;

(iv) injecting the particulate solid carbonaceous material feed stream and carrier gas from the solids feed inlet into the mixing region to form a resultant turbulent mixture of said particulate source of heat, particulate solid carbonaceous material and carrier gas;

(v) passing the resultant turbulent mixture downwardly from said mixing zone to the pyrolysis zone of said pyrolysis reactor to pyrolyze the particulate solid carbonaceous material and yield a pyrolysis product stream containing as particulate solids, the particulate source of heat and a carbon containing solid residue of pyrolysis of the particulate solid carbonaceous material, and a vapor mixture of carrier gas and pyrolytic vapors comprising volatilized hydrocarbons and tars, the pyrolysis time being less than about 5 seconds;

(c) passing the pyrolysis product stream from said pyrolysis reactor to a cyclone separation zone to separate the bulk of the solids from the vapor mixture; and (d) forming the particulate source of heat by:

(i) transporting the separated particulate solids from the cyclone separation zone to a cyclone oxidation-separation stage with a transport gas containing free oxygen with resultant carbon monoxide formation from the carbon in the particulate solids; and (ii) combining the transported particulate solids, carbon monoxide and transport gas in the cyclone oxidation-separation stage with a source of free oxygen in an amount at least equal to 50 mole percent of the carbon monoxide entering the cyclone oxidation-separation stage, the total free oxygen in the transport gas and combined in the oxidation-separation stage being sufficient to heat the transported solids to the temperature required for introduction to the vertically oriented chamber, while simultaneously separating the heated transported solids as the particulate source of heat from the gaseous products of oxidation, the residence time in said cyclone oxidation-separation stage being less than about 5 seconds.

11. A process as claimed in claim 10 in which the pyrolysis temperature is from about 600° to about 1400° F.

12. A process as claimed in claim 10 in which the solid carbonaceous material is an agglomerative coal and the particulate solid carbonaceous material feed stream substantially contains particles of a size from about 10 to about 250 microns in diameter.

13. A process as claimed in claim 10 in which the solid carbonaceous material is an agglomerative coal and the resultant turbulent mixture has a particulate solids content ranging from about 0.1 to about 10% by volume based on the total volume of the resultant turbulent mixture and a weight ratio of the particulate source of heat to particulate solid carbonaceous material of from about 2 to about 20:1.

14. A process as claimed in claim 10 in which the pyrolysis temperature is from about 900° to about 1400° F.

15. A process as claimed in claim 10 in which the pyrolysis time is from about 0.1 to about 3 seconds.

16. A process as claimed in claim 10 in which the residence time in the cyclone oxidation-separation stage is from about 0.1 to about 3 seconds.

17. A continuous process for recovery of values contained in agglomerative coals which comprises the steps of:

(a) producing a particulate agglomerative coal feed stream containing agglomerative coal particles of a size less than about 250 microns in diameter;

(b) subjecting the particulate agglomerative coal feed stream to flash pyrolysis by continuously:

(i) transporting the particulate agglomerative coal feed stream and a carrier gas which is substantially nondeleteriously reactive with respect to the products of pyrolysis of the particulate agglomerative coal to the feed nozzle of a vertically oriented, descending flow pyrolysis reactor having a pyrolysis zone operated at a pyrolysis temperature from about 600° to about 2000° F;

(ii) feeding a particulate source of heat at a temperature above the pyrolysis temperature, and comprising heated particulate carbon containing solid residue of pyrolysis of the particulate agglomerative coal, to a vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate heat source in said chamber being maintained in a fluidized state by the flow therewith of an aerating gas substantially nondeleteriously reactive with respect to the products of pyrolysis of the particulate agglomerative coal feed;

(iii) discharging the particulate source of heat over said weir and downwardly into said mixing region at a rate sufficient to maintain said pyrolysis zone at the pyrolysis temperature;

(iv) injecting the particulate agglomerative coal stream and carrier gas from the feed nozzle into the mixing region to form a resultant turbulent mixture of said particulate source of heat, particulate agglomerative coal feed stream and carrier gas;

(v) passing the resultant turbulent mixture downwardly from said mixing zone to the pyrolysis reactor to pyrolyze the particulate agglomerative coal feed stream and yield a pyrolysis product stream containing as particulate solids, the particulate source of heat and a particulate carbon containing solid residue of pyrolysis of the particulate agglomerative coal feed, and a vapor mixture of carrier gas and pyrolytic vapors comprising tars, intermediate boiling hydrocarbons, and low boiling hydrocarbons, the pyrolysis time being less than about 5 seconds;

(c) passing the pyrolysis product stream from said pyrolysis reactor to a first cyclone separation zone comprising a plurality of cyclone separation stages to initially separate from the pyrolysis product stream the bulk of the particulate solids as coarse particulate solids in at least a first cyclone separation stage and to separate a fines fraction of the particulate solids from the vapor mixture in at least a second cyclone separation stage;

(d) collecting the coarse particulate solids in a collection zone comprising a static bed of particulate solids;

(e) compacting particulate solids from the static bed in a compaction stage for feed to a transport line;

p1 (f) forming the particulate source of heat by:

(i) transporting the particulate solids from the compaction zone to a cyclone oxidation-separation stage with a transport gas containing free oxygen with resultant carbon monoxide formation from the carbon in the particulate solids; and (ii) combining the transported particulate solids, carbon monoxide and transport gas in the cyclone oxidation-separation stage with a source of free oxygen at least equal to 50 mole percent of the carbon monoxide entering the oxidation stage, the total free oxygen in the transport gas and combined in the cyclone oxidation-separation stage being sufficient to raise the particulate solids to a temperature above the pyrolysis temperature, the residence time in said cyclone oxidation-separation stage being less than about 5 seconds, while simultaneously separating the bulk of the transported solids from the gases and a remaining portion of the transported solids in the cyclone oxidation-separation zone to form the particulate source of heat for feed to the vertically oriented chamber; and (g) passing the remaining portion of the transported solids and gases from the cyclone oxidation-separation stage to a cyclone separation zone to separate a fines fraction of the transported solids from the gases.

18. A process as claimed in claim 17 in which the pyrolysis temperature is from about 900° to about 1400° F.

19. A process as claimed in claim 17 in which a substantial portion of the agglomerative coal particles are particles in the range from about 10 to about 250 microns.

20. A process as claimed in claim 17 in which the resultant turbulent mixture has a particulate solids content ranging from about 0.1 to about 10% by volume based on the total volume of the resultant turbulent mixture and a weight ratio of the particulate source of heat to particulate agglomerative coal of from about 2 to about 20:1.

21. A process as claimed in claim 17 in which the pyrolysis time is from about 0.1 to about 3 seconds.

22. A process as claimed in claim 17 in which the residence time in the cyclone oxidation separation stage is from about 0.1 to about 3 seconds.

23. A continuous process for recovery of values contained in solid carbonaceous materials which comprises the steps of:

(a) providing a feed stream containing a particulate solid carbonaceous material, a substantial portion of the particulate solid carbonaceous material being of a particle size less than about 1000 microns in diameter;

(b) subjecting the particulate solid carbonaceous material to flash pyrolysis by continuously:

(i) transporting the particulate solid carbonaceous material feed stream contained in a carrier gas which is substantially nondeleteriously reactive with respect to the products of pyrolysis of the particulate solid carbonaceous material to a solids feed inlet of a substantially vertically oriented, descending flow pyrolysis reactor having a substantially vertically oriented pyrolysis zone operated at a pyrolysis temperature above about 600° F;

(ii) feeding a particulate source of heat at a temperature above the pyrolysis temperature to a substantially vertically oriented chamber surrounding the upper portion of the pyrolysis reactor, the chamber having an inner peripheral wall forming an overflow weir to a vertically oriented mixing section of the vertically oriented descending flow pyrolysis reactor, the particulate source of heat in said chamber being maintained in a fluidized state by the flow therewith of an aerating gas substantially nondeleteriously reactive with respect to the products of pyrolysis of the particulate solid carbonaceous material;

(iii) discharging the particulate source of heat over said weir and downwardly into said mixing region at a rate sufficient to maintain said pyrolysis zone at the pyrolysis temperature;

(iv) injecting the particulate solid carbonaceous material feed stream and carrier gas from the solids feed inlet into the mixing region to form a resultant turbulent mixture of the particulate source of heat, the particulate solid carbonaceous material and carrier gas;

(v) passing the resultant turbulent mixture downwardly from said mixing zone to the pyrolysis zone of said pyrolysis reactor to pyrolyze the particulate solid carbonaceous material and yield a pyrolysis product stream containing as particulate solids, the particulate source of heat and a particulate carbon containing solid residue of pyrolysis of the particulate solid carbonaceous material, and a vapor mixture of carrier gas and pyrolytic vapors comprising volatilized hydrocrabons including tars;

(c) passing the pyrolysis product stream from said pyrolysis reactor to a separation zone to separate at least the bulk of the particulate solids from the vapor mixture; and (d) forming the particulate source of heat by subjecting carbon in the separated particulate solids to oxidation by:

(i) transporting the separated particulate solids from the separation zone to a cyclone oxidation-separation stage with a transport gas containing free oxygen with resultant carbon monoxide formation from the carbon in the particulate solids; and (ii) combining the transported particulate solids, carbon monoxide and transport gas in the cyclone oxidation-separation stage with a source of free oxygen in an amount at least equal to 50 mole percent of the carbon monoxide entering the cyclone oxidation-separation stage, the total free oxygen in the transport gas and combined in the oxidation-separation stage being sufficient to raise the solids to the temperature required for introduction to the vertically oriented chamber, while simultaneously separating the gaseous products of oxidation from the heated particulate source of heat, the residence time in said cyclone oxidation-separation stage being less than about 5 seconds.

24. A process as claimed in claim 23 in which the pyrolysis temperature is from about 600° to about 2000° F.

25. A process as claimed in claim 23 in which the pyrolysis temperature is from about 600° to about 1400° F.

26. A process a claimed in claim 23 in which the pyrolysis temperature is from about 900° to about 1400° F.

27. A process as claimed in claim 23 in which a substantial portion of the particulate solid carbonaceous material are particles in the range from about 10 to about 1000 microns in diameter.

28. A process as claimed in claim 23 in which the solid carbonaceous material is an agglomerative coal and a substantial portion of the particulate solid carbonaceous material is of a particle size less than about 250 microns in diameter.

29. A process as claimed in claim 23 in which the particulate solid carbonaceous material is an agglomerative coal, and a substantial portion of the particulate solid carbonaceous material is of a particle size in the range from about 10 to about 250 microns in diameter.

30. A process as claimed in claim 23 in which the resultant turbulent mixture has a solids content ranging from about 0.1 to about 10% by volume based on the total volume of the resultant turbulent mixture and a weight ratio of the particulate source of heat to solid carbonaceous material feed of from about 2 to about 20:1.

31. A process as claimed in claim 23 having a pyrolysis time of less than about 5 seconds.

* * * * *

UNITED STATES PATENT AND TRADEMARK OFFICE

CERTIFICATE OF CORRECTION

PATENT NO. : 4,102,773
DATED : July 25, 1978
INVENTOR(S) : NORMAN W. GREEN, KANDASWAMY DURAISWAMY, ROBERT E. LUMPKIN It is certified that error appears in the above-identified patent and that said Letters Patent are hereby corrected as shown below:

Column 1, addition: Below title, insert -- The Government has rights in or in respect of this invention pursuant to Contract No. E(49-18)-2244 awarded by the U.S. Energy Research and Development Administration --.

Column 7, line 30, delete second occurrence of the word, "in". Column 10, line 47, for "annulargap" read -- annular gap --. Column 13, line 5, for "cyclone" read -- cyclones --. Column 14, line 33, for "of" read -- or --. Column 17, line 47, for "from" read -- form --. Column 18, line 59, for "an" read -- as --. Column 19, line 11, for "amonia" read -- ammonia --. Column 20, line 56 for "2565" read -- 2564 --. Column 21, line 4, for "in" read -- for --. Column 21, line 6, delete "of".

Column 21, line 17 (Claim 1), for "paticulate" read -- particulate --. Column 24, line 16 (claim 13), insert after the word, mixture -- stream --. Column 25, line 27 (Claim 17), delete "pl". Column 26, line 59 (Claim 23), for "hydrocrabons" read -- hydrocarbons --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*